US006625254B2

(12) United States Patent
Bachmann et al.

(10) Patent No.: US 6,625,254 B2
(45) Date of Patent: Sep. 23, 2003

(54) WINDOW TRANSPARENT TO ELECTRON RAYS

(75) Inventors: Peter Klaus Bachmann, Wuerselen (DE); Volker Van Elsbergen, Aachen (DE); Bernd David, Huettblek (DE); Rainer Willi Eckart, Hamburg (DE); Geoffrey Harding, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/973,313

(22) Filed: Oct. 9, 2001

(65) Prior Publication Data

US 2002/0048345 A1 Apr. 25, 2002

(30) Foreign Application Priority Data

Oct. 13, 2000 (DE) ..... 100 50 811

(51) Int. Cl.[7] ..... G21K 1/00
(52) U.S. Cl. ..... 378/161; 378/140
(58) Field of Search ..... 378/161, 140

(56) References Cited

U.S. PATENT DOCUMENTS 5,173,612 A * 12/1992 Imai et al. ..... 378/161
5,305,364 A * 4/1994 Mochiji et al. ..... 378/161
5,612,588 A 3/1997 Wakalopulos ..... 313/420

FOREIGN PATENT DOCUMENTS

| | | | | |
|---|---|---|---|---|
| EP | 0365366 A1 | 4/1990 | ..... | C23C/16/26 |
| EP | 0761623 A2 | 3/1997 | ..... | C04B/37/00 |
| EP | 0957506 A1 | 11/1999 | ..... | H01J/35/18 |
| EP | 19821939 | 11/1999 | | |
| GB | 1243625 | 8/1971 | ..... | H01J/33/04 |
| GB | 2288272 A | 10/1995 | ..... | H01J/35/18 |
| WO | 0175500 A1 | 10/2001 | ..... | G02B/7/00 |

* cited by examiner

*Primary Examiner*—Craig E. Church
(74) *Attorney, Agent, or Firm*—John Vodopia

(57) ABSTRACT

The invention relates to a window transparent to electron rays comprising a foil (1, 10, 300*a*) transparent to electron rays and separated from a carrier substrate as well as a retaining element (2, 300*b*) for supporting a peripheral region of the foil transparent to electron rays in the operational state, which retaining element (2, 300*b*) is made of a material which has a linear thermal expansion coefficient which matches the linear thermal expansion coefficient of the foil material.

The invention further relates to a method of manufacturing a window transparent to electron rays and an X-ray device with such a window.

9 Claims, 3 Drawing Sheets

WINDOW TRANSPARENT TO ELECTRON RAYS

The invention relates to a window transparent to electron rays as well as to a method of manufacturing such a window, wherein said window comprises a foil which is transparent to electron rays and an element for supporting a peripheral region of the foil which is transparent to electron rays in the operational state. The invention also relates to an X-ray radiation device.

Such windows are used wherever sensitive objects are to be screened from external circumstances, while nevertheless a sufficient transparency for the passage of the electron ray is safeguarded. DE 198 21 939 A1 proposes the use of such windows in an X-ray tube with a liquid metal target, which is also referred to as LIMAX X-ray tube (LIMAX=LIquid Metal Anode X-ray tube). Such an X-ray device basically consists of an electron source and a target made of a metal which circulates in the operational state of the radiator. The liquid metal is present in a pump circulation system and is pumped from a divider head via a special steel plate into a receptacle. The electron ray hits the liquid metal flowing over the special steel plate and generates X-radiation therein. It is achieved by means of the window that the vacuum space of the electron source and the target are separated from one another so as to form two independent spaces, such that the target becomes less sensitive to the kind of flow and to the choice of liquid metal. A window used here comprises, for example, a diamond foil which is vapor-deposited on a silicon carrier substrate, whereupon the carrier substrate is partly removed for creating a window region or transmission zone for the electron ray. The window thus constructed is directly mounted in the X-ray tube.

It should be noted here that a distinction is made between the terms carrier substrate and retaining element in the context of the present invention. The carrier substrate serves as a deposition surface or auxiliary surface for manufacturing the window foil, whereas the retaining element serves as a positioning aid for the foil in its operational position.

It was found that windows known from DE 198 21 939 A1 are not resistant to pressure differences of more than 4 bar because at higher pressure differences the diamond film is torn from the silicon substrate owing to insufficient adhesion, i.e. the window bursts open. The bursting pressure is reached during the starting phase of X-ray tube operation, when pressure differences of more than 4 bar occur, in particular in the case of LIMAX tubes.

The invention accordingly has for its object to provide a window transparent to electron rays and a corresponding method of manufacturing such a window, which can remain reliably intact as a separation element under various conditions and/or fluctuating conditions between two spaces. In particular, a window is to be provided for overpressure and vacuum applications which is capable of withstanding pressure differences also of more than 4 bar in its operational state.

This object is achieved by means of a window transparent to electron rays which comprises a foil transparent to electron rays and separated from a carrier substrate as well as a retaining element for supporting a peripheral region of the foil transparent to electron rays in the operational state, wherein the retaining element is made of a material which has a linear thermal expansion coefficient adapted to the linear thermal expansion coefficient of the foil material, such that it is equal or similar thereto.

Preferably, the foil transparent to electron rays is made of diamond with a thickness of no more than 10 $\mu$m. In an alternative embodiment, the foil may also be made of molybdenum or of beryllium.

It is preferable in the case of diamond foil that the retaining element is made of a material having a linear thermal expansion coefficient smaller than or equal to $9\times10^{-6}$/K; particularly preferred is the choice of a material having a linear thermal expansion coefficient lying within the range of $0.5–1\times10^{-6}$/K to $9\times10^{-6}$/K. The lower limit value follows from the linear thermal expansion coefficient of diamond. The linear thermal expansion coefficient of ideal diamond as a monocrystal lies at $0.5\times10^{-6}$/K, which coefficient rises to a value of approximately $1\times10^{-6}$/K in the manufacture by a CVD method and the accompanying formation of polycrystalline material.

The retaining element is preferably made of materials such as molybdenum with a linear thermal expansion coefficient between 5 and $6\times10^{-6}$/K, tungsten, titanium, tantalum, as well as their low alloys, glasses, ceramic materials with suitably low linear thermal expansion coefficients, also diamond, and possibly materials having a lower linear thermal expansion coefficient than diamond, especially than diamond in its polycrystalline form.

In a first advantageous embodiment, the foil transparent to electron rays and the retaining element are integrally made of diamond. Particularly advantageous here is the integral embodiment of the window with the retaining element, manufactured from an integral diamond plate with an original thickness of more than 10 $\mu$m.

In a second, alternative embodiment, the foil transparent to electron rays and the retaining element are constructed as two parts, the foil with a thickness of less than 10 $\mu$m, preferably less than 5 $\mu$m, being provided on the retaining element with an interposed connecting layer. Both the foil and the retaining element may preferably each be made of diamond or each be made of molybdenum also in this second embodiment. Choosing the same material for the foil and the retaining element gives an optimum matching of the thermal expansion behaviors.

In contrast to a conventional window, which is formed by a carrier substrate with a foil deposited thereon and which does not withstand higher pressure differences because of the comparatively small adhesive forces between the carrier substrate and the foil, leading to a stripping of the foil from the carrier substrate, the window proposed here has a reliable connecting layer. The material of the retaining element is chosen such that its material behavior is adapted to that of the diamond foil, so that the two materials react to external influences with similar changes in volume. Overall, a window is obtained which withstands pressure differences of more than 4 bar and which is also suitable as a separation means for spaces in which different conditions prevail, for example because of differences in contents (liquids of different compositions in different aggregation states).

The connecting layer of the embodiment in two parts is preferably formed by a fusion layer of an active metal solder or a glass fusion. This is provided on the connecting surfaces of the retaining element. The carbide formers contained in the active metal solder such as, for example, titanium or molybdenum, react with the foil at the contact surface—with the carbon present therein in the case of a diamond foil—so as to form metal carbides which achieve a fixed connection between the foil and the retaining element. Similarly advantageous is an adhesive layer, for example on the basis of an epoxy resin or a temperature-resistant ceramic adhesive, for example supplied by the Aremco Company. Preferably, the connecting layer may also be formed by a combined adhesion/fusion layer, in which case in particular the combination of glass fusion with ceramic adhesives is to be mentioned.

It is furthermore proposed that at least one surface of the foil transparent to radiation comprises at least one thickening—extending to beyond the surface area of the foil—whose thickness amounts to at least 10% of the foil thickness. The proposed thickenings, representing mechanical reinforcement ridges or reinforcement patterns, should preferably, but need not necessarily, be of a thickness which is in particular smaller than the total thickness of the foil, but should be at least 10% of the foil thickness. The thickenings are provided at regular intervals—for example as reinforcement elements running in parallel or forming a grid—or alternatively at irregular intervals. Said thickenings stabilize the foil mechanically while nevertheless leaving open regions of higher transparency for the electron ray.

Reference should be made here to EP 0 476 827 A1 which discloses windows which are transparent to X-rays, and which are thus of a different kind, because windows transparent to electron rays have to comply with fundamentally different boundary conditions for the transparency than X-ray-transparent windows. An X-ray window is described in this cited document which comprises a diamond foil transparent to X-rays, a carrier substrate, for example made of silicon, on which the diamond foil is deposited, and a carrier ring acting as a retaining element for supporting a peripheral region of the foil transparent to X-rays. The diamond foil is provided with reinforcement crosspieces also made of diamond on its surface for enhancing its mechanical strength. The carrier ring is made of aluminum. To manufacture such a window, a planar carrier substrate is vaporized with a gas containing carbon in a gas phase deposition process—for example a CVD (Chemical Vapor Deposition) process—, such that a diamond foil with a thickness of between 0.05 and 10 $\mu$m is grown. A mask is provided which has recesses in those locations where the reinforcement ridges should lie, and which counteracts a diamond deposition in other locations. When the thickness of the reinforcement crosspieces has become greater than that of the foil, the deposition is stopped, the mask is removed, the carrier substrate is etched away centrally in the subsequent window region, and the substrate is connected to the carrier ring. The substrate may alternatively be fully etched away, in which case the aluminum carrier ring is directly connected to the diamond foil.

A manufacturing method for the integral embodiment according to the invention is proposed in which in a first step a monocrystalline or polycrystalline diamond plate with a thickness of between 10 and 1000 $\mu$m is manufactured, which plate is thinned to a thickness transparent to an electron ray in a central region over a surface area corresponding at least to the diameter of the electron ray. This thinning is preferably achieved by means of a known laser or ion irradiation process. Depending on the diameter of the electron ray, this zone will typically have rectangular dimensions smaller than 5 to 2 mm. In an advantageous modification of the process, this integral window may be provided with reinforcement elements in that the central zone of the plate is irregularly thinned. It is advisable in this case to thin the edge regions of the central transmission zone less strongly, such that the thickened portions are present in the outermost regions of the thinned, i.e. processed zone. The passage of the electron ray through the transmission zone thus remains substantially unhampered. Thinning with different processing depths is controlled by means of the supplied power.

In an advantageous embodiment, moreover, electrically conductive diamond is to be used, which is achieved, for example, through doping of the diamond foil or the diamond plate with boron during the gas phase deposition.

Advantageously, the proposed window is used in an X-ray device having the characteristics defined in claim 16, but its use is obviously not limited to this application.

Further particulars and advantages of the invention will become apparent from the ensuing description in which the embodiments of the invention shown in the Figures are explained in more detail. Besides the combinations of characteristics given above, individual characteristics or other combinations thereof also form part of the invention. In the diagrammatic drawings.

Figure 1:
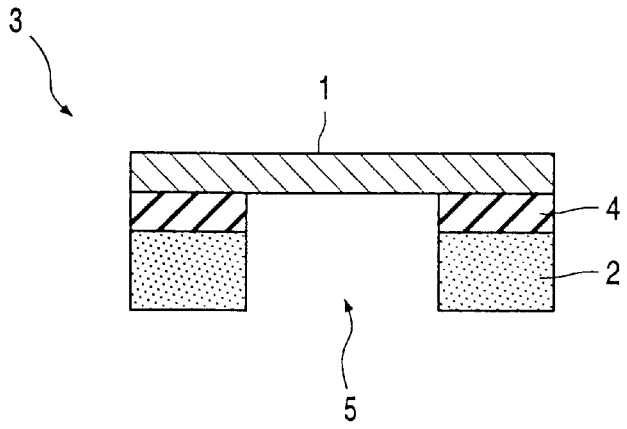
FIG. 1 is a cross-sectional view of a two-part embodiment of the window transparent to electrons according to the invention.

FIG. 1 is a cross-sectional view of a window 3 built up in two parts from a diamond foil 1 and a separate annular retaining element 2, wherein the foil 1 and the retaining element 2 are connected to one another by means of an adhesive or fusion layer 4. The diamond foil 1 has a thickness of up to 10 $\mu$m and is transparent to an electron ray. The material of the retaining element 2 is characterized in that it is a temperature-resistant metal and has a linear thermal expansion coefficient whose value is preferably lower than $9\times10^{-6}$/K, i.e. similar or equal to the coefficient of expansion of the diamond. An example of this is molybdenum. It is also conceivable, however, that the foil transparent to electron rays is made of molybdenum and that the retaining element is manufactured from a material whose thermal expansion behavior matches that of molybdenum.

It should be emphasized that the retaining element 2 did not take part in the actual manufacture of the diamond foil, acting as a carrier substrate, but that it was connected to the diamond foil only after the latter had been manufactured.

The manufacture of thin diamond layers is known and takes place by means of gas deposition methods. The diamond foil is then fully divested of the carrier substrate on which it was deposited—for example, by etching or possibly by grinding away of the substrate—and is connected to the retaining element 2 by its peripheral or edge regions, such that a transparent transmission zone 5 is created.

Figure 2:
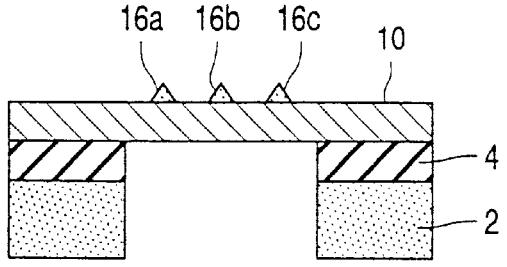
FIG. 2 is a cross-sectional view of a further version of the two-part embodiment of FIG. 1.
Figure 3:
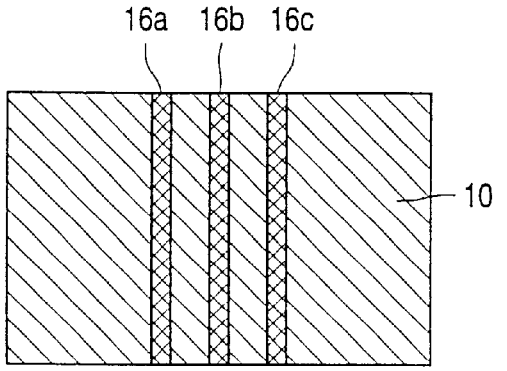
FIG. 3 is a plan view of the further version of FIG. 2.

The thin diamond layer 10 is provided with thickenings 16*a,b,c* acting as structural or reinforcement elements on its surface facing away from the retaining element 2 for mechanical stabilization of the thin diamond layer, as is shown for the embodiment in FIG. 2. Similar components have been given the same reference numerals as in FIG. 1. These thickenings 16*a,b,c* are also formed from diamond and in this embodiment extend parallel next to one another, which is more clearly shown in the plan view of FIG. 3. Embodiments with irregularly spaced thickenings are equally conceivable; and other geometries or patterns in which the thickenings are arranged are also possible. In the window shown in FIG. 2, the thickenings 16*a,b,c* have a triangular geometry. Their thickness does not come to the total thickness of the diamond foil, but it should be at least 10% of the total thickness of the foil. It is furthermore possible to provide both surfaces of the diamond foil with thickenings, or only the surface facing towards the retaining element. A balance should always be sought between the influence of a mechanical stabilization and sufficient areas of higher transparency acting as transmission zones for the electron ray. The thickenings may be added to the diamond foil, for example, through a suitable structuring of the CVD carrier substrate to be coated during the deposition process. It is also possible, however, to remove regions, for example by laser ablation or with an ion ray applied to a thicker foil, which regions will then form the subsequent regions transparent to electron rays.

Figure 4:
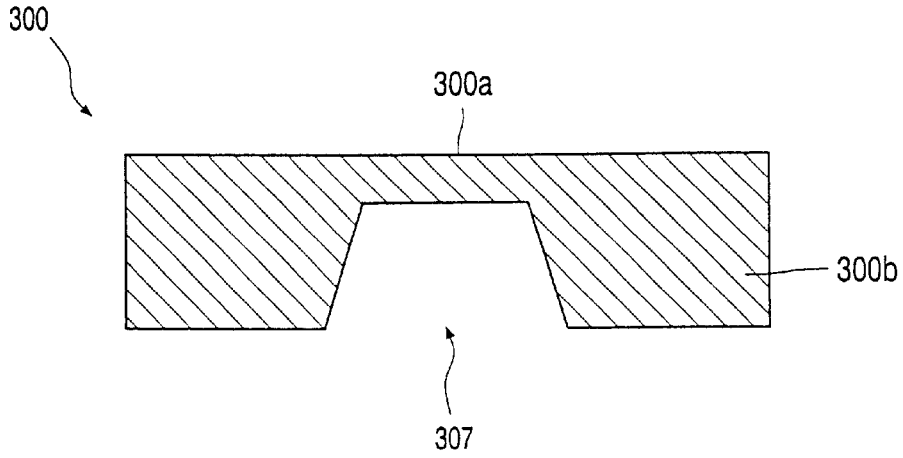
FIG. 4 is a cross-sectional view of an integral embodiment of the window transparent to electron rays according to the invention.
Figure 5:
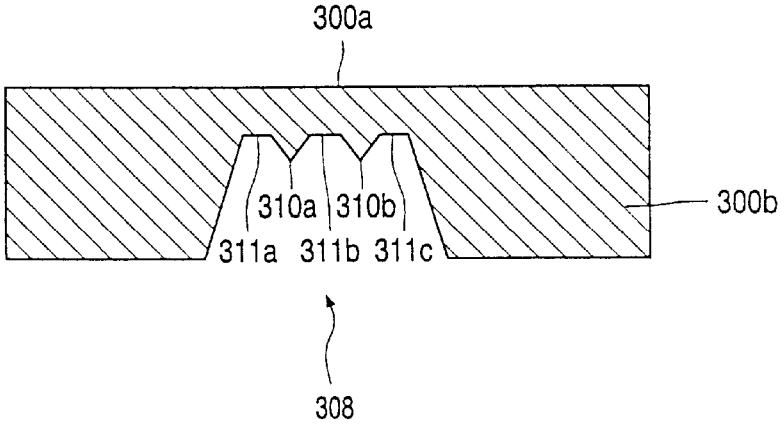
FIG. 5 is a cross-sectional view of an embodiment of the window of FIG. 4 with an irregular diamond foil thickness.
Figure 6:
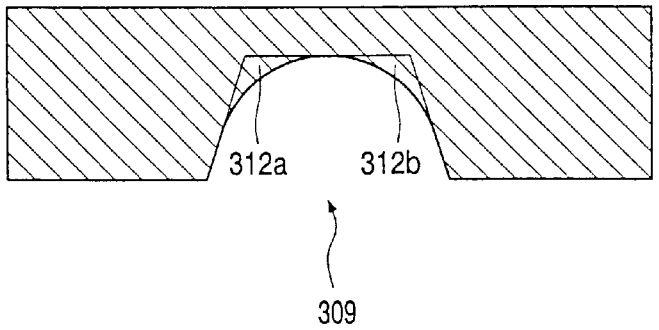
FIG. 6 is a cross-sectional view of a second embodiment of the window of FIG. 4 with an irregular diamond foil thickness.

Besides the solution principle of a fixed connection through the use of an adhesion of fusion layer between the diamond foil and the retaining element of a material having a low linear thermal expansion coefficient, the solution principle of an integral window is proposed according to the invention, which window consists entirely of diamond. FIG. 4 is a cross-sectional view of such a window. The foil (300*a*) and the retaining element 300*b* in this embodiment form an integral whole, i.e. the window 300. A diamond plate having a thickness of more than 10 $\mu$m, preferably of up to 1000 $\mu$m, is used for this, which plate is thinned by laser or ion ablation down to a thickness which is transmissive to electrons over a surface area which corresponds to at least the diameter of the electron ray. This creates the actual window region 307 within the retaining element 300*b*. Besides this regular arrangement of the window region, the embodiment of FIG. 5, also made integrally from diamond, shows an irregularly thinned diamond plate, i.e. a transmission zone 308 reinforced with thickened portions 310*a,b*. The electron ray can pass through the regions 311*a,b,c* transparent to electron rays between the thickened portions. In the advantageous embodiment shown in FIG. 6, the thickened portions, i.e. the non-reduced regions 312*a,b* lie in the outermost region of the processed zone or transmission zone 309; the difference with the window of FIG. 5 is shown in dotted lines. With a sufficient stabilization, the actual transmission zone 309 still remains unaffected.

Figure 7:
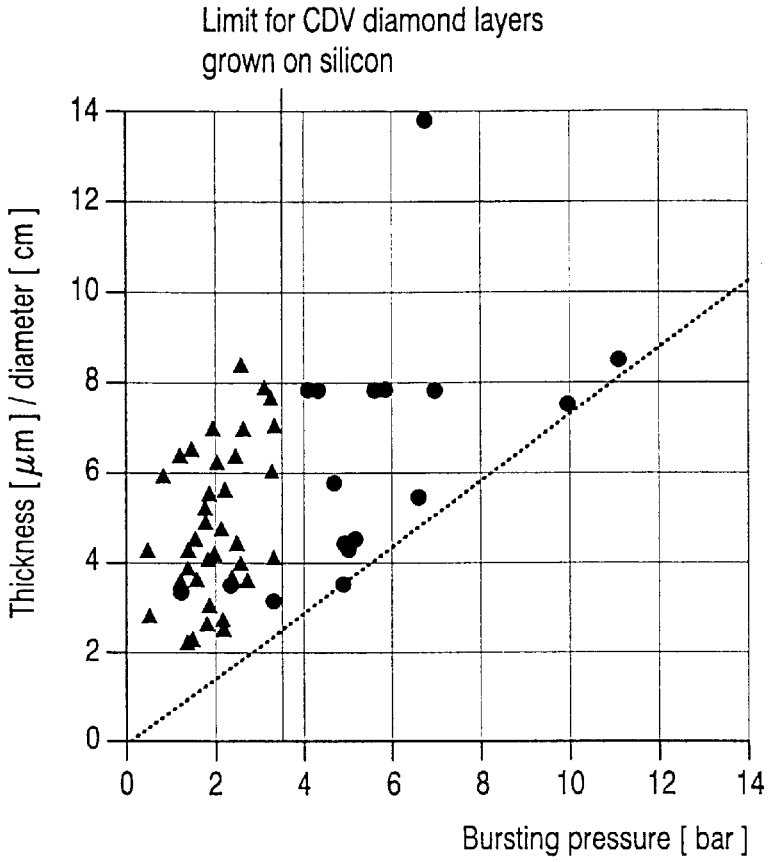
FIG. 7 is a diagram showing the relationship between window geometries and bursting pressure for traditionally constructed windows (triangles) and windows according to the invention (dots)

It is clarified in the diagram of FIG. 7 that the windows with the proposed construction show a better pressure resistance than the known windows which are formed by a carrier substrate with a diamond foil provided in the deposition process. The bursting pressure is indicated as a measure for this. The thickness and the diameter indicate geometric values for the respective window. The diameter is understood to be the greatest longitudinal dimension of the window opening, i.e. of the transmission zone in cm here, corresponding, for example, to the diameter in circular openings, to the major axis of the ellipse in elliptical openings, and to the major side length in the case of rectangular openings. It is apparent that the window samples with less strongly adhering foils on silicon carrier substrates (triangles) became detached at a pressure of 3 to 4 bar. To achieve higher bursting pressures (dots), the diamond foil was fully removed from the carrier substrate, according to the invention, and fixedly connected to a separate retaining element or window frame from a material having a comparatively low linear thermal expansion coefficient by means of a separate connecting layer, or alternatively it was manufactured in one piece. The dotted line corresponds to the experimentally found limit value for the bursting pressure of the window, for which it holds that $$\text{bursting pressure (bar)} = 1.3 \times [\text{thickness}(\mu m)/\text{diameter}(cm)],$$

whereby a difference from the known relation $$\text{bursting pressure (bar)} = 1 \times [\text{thickness}(\mu m)/\text{diameter}(cm)]$$

was found.

The window thickness in $\mu$m should accordingly be greater than 0.7 times the product of diameter (cm) and pressure difference between the two sides of the window.

Figure 8:
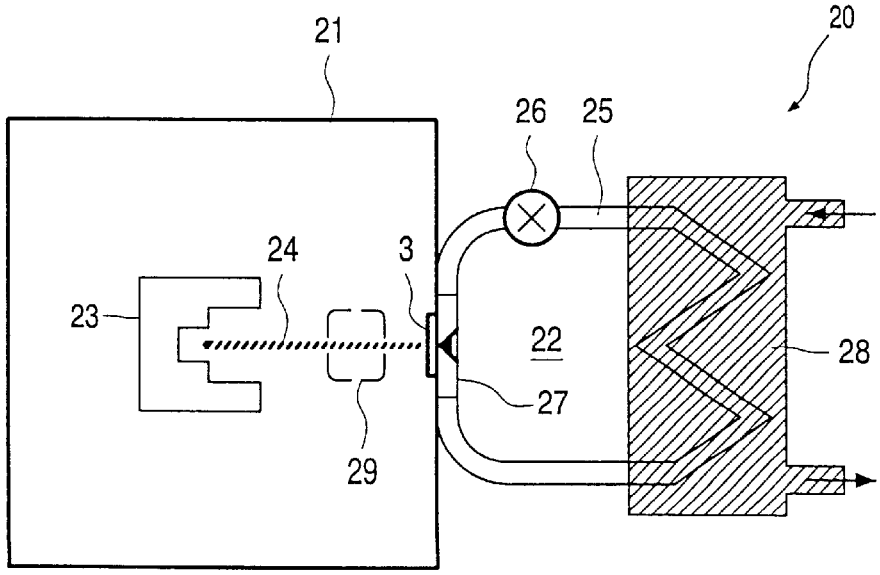
FIG. 8 shows an X-ray device with a window transparent to electron rays according to the invention.

FIG. 8 diagrammatically shows an X-ray device 20 operating by the LIMAX process, in which a window 3 according to the invention with its modifications described above may advantageously be used. The X-ray device is formed by the X-ray tube 21 and a liquid metal circulation system 22. The X-ray tube 21 is closed off by the window 3 in a vacuumtight manner. In the vacuum space of the X-ray tube 21, there is an electron source in the form of a cathode 23 which in the operational state emits an electron ray 24 which hits a liquid metal through the window 3, which metal is being passed over a steel plate. The liquid metal circulation system 22 is provided for this purpose, composed from a tubular duct system 25 in which the liquid metal is propelled by a pump 26 so as to flow past the outer side of the window 3 in a region 27. After passing through the region 27, it enters a heat exchanger 28 from which the generated heat is removed by means of a suitable cooling system. The interaction of the electrons passing through the window with the liquid metal generates X-ray radiation (i.e. the liquid metal acts as a target), which issues through the window 3 and an X-ray emission window 29 in the bulb 21 to the exterior.

It is advisable to use a doped diamond, especially if the proposed windows are used in such X-ray devices, so as to prevent a charging of the window during operation by means of the conductivity, and thus to prevent a deflection, deceleration, or complete stoppage of the electron ray. Boron is suitable for a doping process so as to reduce the resistivity to less than 1000 Ωcm.

What is claimed is:

1. A window transparent to electron rays comprising:

a foil transparent to electron rays and separated from a carrier substrate;

a retaining element connected to a peripheral region of the foil for supporting in the operational state a central region of the foil that is transparent to electron rays, the foil transparent to electron rays and the retaining element being constructed as two separate parts and the retaining element being made of a material which has a linear thermal expansion coefficient adapted to the linear thermal expansion coefficient of the foil material; and a connecting layer interposed between the foil and the retaining element for connecting the foil to the retaining element.

2. A window transparent to electron rays as claimed in claim 1, wherein the foil transparent to electron rays is made of diamond.

3. A window transparent to electron rays as claimed in claim 1, wherein the foil transparent to electron rays is made of molybdenum.

4. A window transparent to electron rays as claimed in claim 2, wherein the retaining element is made of a material having a linear thermal expansion coefficient smaller than $9 \times 10^{-6}$/K.

5. A window transparent to electron rays as claimed in claim 1, wherein the retaining element is made from a material selected from a group comprising the following materials: metals such as molybdenum, tungsten, titanium, tantalum an their alloys, diamond, glasses, and ceramic materials having correspondingly low linear thermal expansion coefficients.

6. A window transparent to electron rays as claimed in claim 1, wherein the interposed connecting layer is a fusion layer of an active metal solder or a glass fusion layer or a combined adhesion-fusion layer.

7. A window transparent to electron rays as claimed in claim 1, wherein at least one surface of the foil transparent to electron rays comprises at least one thickening whose thickness is at least 10% of the foil thickness, the at least one surface being a surface facing away from the retaining element.

8. A window transparent to electron rays comprising:

a foil transparent to electron rays and separated from a carrier substrate, the foil transparent to electron rays being made of diamond; and a retaining element connected to a peripheral region of the foil for supporting in the operational state a central region of the foil that is transparent to electron rays, wherein the retaining element is made of a material which has a linear thermal expansion coefficient adapted to the linear thermal expansion coefficient of the foil material and the following holds for the thickness of the diamond foil:

$$\text{thickness } (\mu\text{m}) < 0.7\text{L(cm)} \times \Delta p\text{(bar)}$$

with $\Delta p$ (bar) representing the pressure difference between the two sides of the window, and L being the greatest longitudinal dimension of the window opening.

9. An X-ray device with an electron source for the emission off electrons, with a target made of a liquid metal circulating in an operational state of the X-ray device and emitting X-ray radiation when hit by the electrons, and with a window transparent to electron rays serving as a separation element between the electron source and the target; the window comprising:

a foil transparent to electron rays and separated from a carrier;

a retaining element connected to a peripheral region of the foil for supporting in the operational state a central region of the foil that is transparent to electron rays, the foil transparent to electron rays and the retaining element being constructed as two separate parts and the retaining element being made of a material which has a linear thermal expansion coefficient adapted to the linear thermal expansion coefficient of the foil material; and a connecting layer interposed between the foil and the retaining element for connecting the foil to the retaining element.

* * * * *